United States Patent [19]

Bond

[11] Patent Number: 4,779,296

[45] Date of Patent: Oct. 25, 1988

[54] LIMB SUPPORTING DEVICE

[76] Inventor: Helen I. Bond, Praire Road at Sunset, R.R. #1, Fremont, Nebr. 68025

[21] Appl. No.: 110,419

[22] Filed: Oct. 20, 1987

[51] Int. Cl.[4] ..... A47C 20/02

[52] U.S. Cl. ..... 5/436; 5/443

[58] Field of Search ..... 5/431, 434, 436, 437, 5/441–443, 446; 297/438, 439

[56] References Cited

U.S. PATENT DOCUMENTS

| | | | |
|---|---|---|---|
| 247,892 | 10/1881 | Doremus | 5/437 X |
| 2,562,725 | 7/1951 | Leto et al. | 5/431 |
| 3,327,330 | 6/1967 | McCullough | 5/436 X |
| 3,849,810 | 11/1974 | Degan | 5/437 X |
| 4,345,347 | 8/1982 | Kantor | 5/436 X |
| 4,679,263 | 7/1987 | Honer | 5/442 X |

*Primary Examiner*—Michael F. Trettel

*Attorney, Agent, or Firm*—George R. Nimmer

[57] ABSTRACT

A limb supporting device for reclining persons has a tri-segments pillow having a volumetrically predominate and apexial central-segment flanked by hingedly associated lower secondary-segments for uprightly stabilizing the limb supporting device upon a bed-like reclining surface. An elongate girth strap gives selectable contour and resiliency to the pillow central-segment according to the limb cradling needs of specific reclining persons.

10 Claims, 1 Drawing Sheet

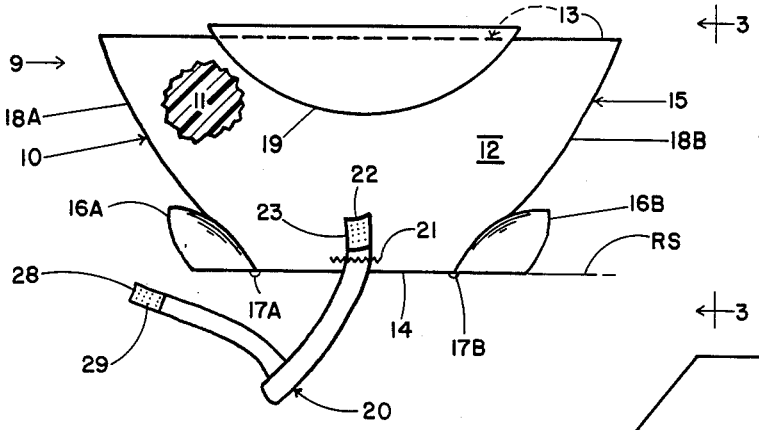
FIG. 1
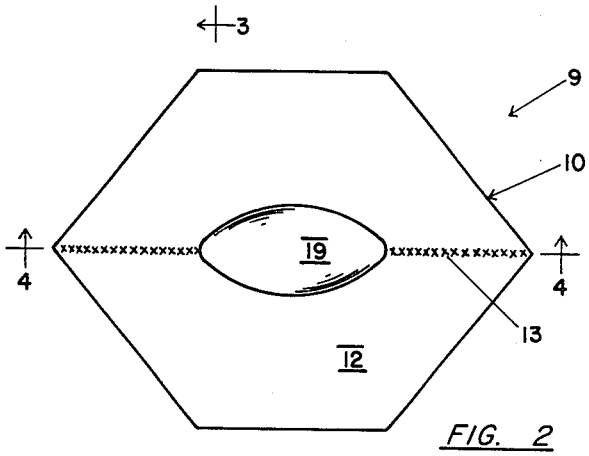
FIG. 2
FIG. 4
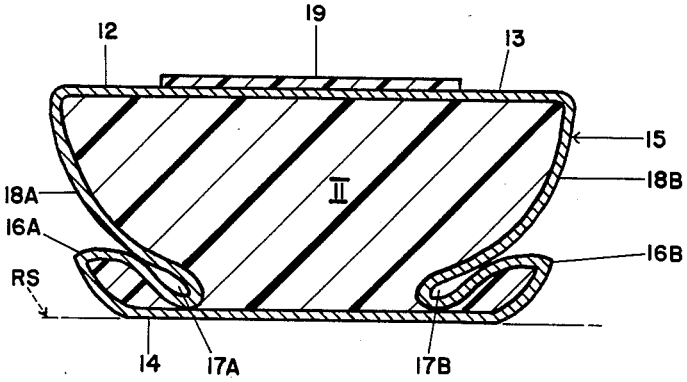
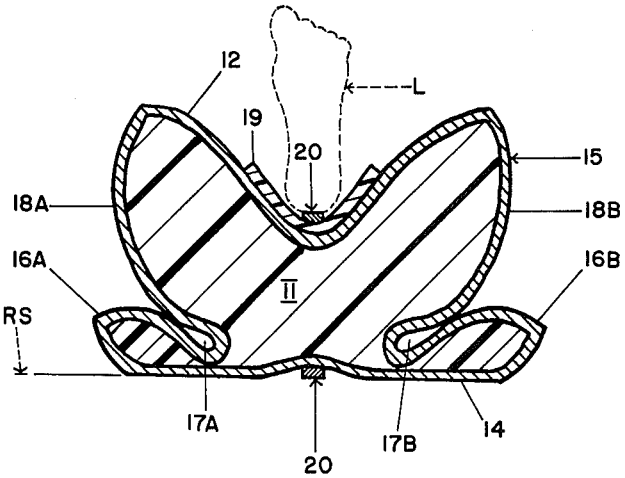
FIG. 4A
FIG. 3
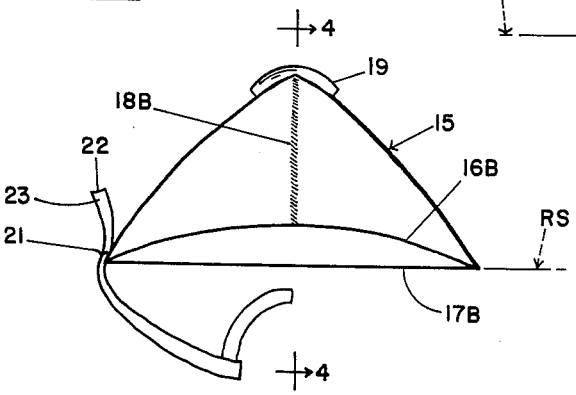

LIMB SUPPORTING DEVICE

BACKGROUND OF THE INVENTION

For persons reclining upon a sleeping bed or other substantially horizontal reclining surface, it is sometimes desireable to support the arm or leg body limb in a secure horizontal position but elevated slightly above the reclining surface. For example, victims of arm or leg trauma, the bedridden chronically subjected to bedsores, persons suffering from poor veinal circulation, as well as sufferers of various other maladies, are advised or instinctively desire to securely maintain the afflicted arm or leg some small distance above the bed-like reclining surface. Although conventional pillows as underlying props do provide a measure of relief, they lack sufficient lateral support for the afflicted arm or leg; moreover, an arbitrarily selected conventional pillow has a built-in constant resiliency which may not be suitable for the afflicted person's particular needs.

OBJECT OF THE INVENTION

It is accordingly the general objective of the present invention to provide for reclining persons a limb supporting device that comfortably supports the afflicted limb reliably laterally securely and together with a selectable degree of resiliency that are not attainable with conventional pillows or with other prior art devices.

GENERAL STATEMENT OF THE INVENTION

With the aforementioned general objective in view, and together with other ancillary and specific objectives which will become more apparent as this description proceeds, the limb supporting device concept of the present invention generally comprises a multi-segments resiliently-compressible pillow having an apexial and volumetrically predominate central-segment for cradling a reclining person's limb and also having secondary-segments respectively hingedly flanking lower portions of the central-segment and for stabilizing the limb supporting device upon a reclining surface, and an elongate girth strap attached to the pillow and adapted to constrictably controllably surround the central-segment to effect a selectable downwardly concave cradle-like contour and a selectable resiliency for the central-segment and to thereby provide a customizeable underlying support for the person's limb.

BRIEF DESCRIPTION OF THE DRAWING

In the drawing, wherein like characters refer to like parts in the several views, and in which:

FIG. 1 is a lengthwise and longitudinal directional side elevational view of a representative embodiment (9) of the limb supporting device concept of the present invention;

FIG. 2 is a top plan view of the FIG. 1 representative embodiment;

FIG. 3 is a widthwise and transverse directional side elevational view of the FIG. 1 embodiment, as seen along line 3—3 of FIG. 1;

FIG. 4 is a lengthwise directional sectional elevational view taken along line 4—4 of FIGS. 2 and 3; and FIG. 4A is a sectional elevational view akin to that of FIG. 4 but showing a girth strap component controllably constrictably surrounding the multi-segments pillow portion of the limb supporting device.

DETAILED DESCRIPTION OF THE DRAWING

The limb supporting device concept of the present invention generally comprises a multi-segments, resiliently-compressible (11) pillow (10) having an apexial and volumetrically predominate central-segment (15) having a longitudinal upper-edge (13) for supporting a reclining person's limb (e.g. leg L) above the horizontal reclining surface (RS) and also having secondary-segments (16A, 16B) hingedly (17A, 17B) flanking lower portions of the central-segment and collectively providing a horizontal longitudinal lower-edge (14) for stabilizing the device upon such reclining surface, and further comprises girth strap means (20) adapted to controllably constrictably surround the pillow central-segment (15) to thereby provide a cradle-like limb support of selectable resiliency as suggested by FIG. 4A.

A flexible shell 12, such as fabric material, surroundably encloses resiliently compressible filling material 11 into a pillow form 10 having generally parallel, horizontal and directionally longitudinal edges 13 and 14. In directions substantially perpendicular to pillow horizontal lower-edge 14, flexible shell 12 is horizontally and directionally transversly linearly joined together (e.g. by stitched lines 17A, 17B) to subdivide pillow 10 into three resiliently-compressible (11) segments, namely: an apexial and volumetrically predominate central-segment 15 having its lower portion flanked by hingedly associated (17A, 17B) secondary-segments 16A and 16B. Accordingly, the longitudinally extending upper-edge 13 of and having a finite-length is wholly defined by the apex or horizontal upper extremity of central-segment 15, and the longitudinally extending lower-edge 14 of pillow 10 is jointly defined by the collective lower extremities of pillow segments 15, 16A, and 16B. Moreover, pillow central-segment 15 has a pair of inclined and downwardly convergent side edges including:

(a) a left-edge 18A extending from the leftward terminus of pillow upper-edge 13 to the leftward hinged connection 17A, said left-edge 18A physically contacting pillow leftward secondary-segment 16A; and (b) a right-edge 18B extending from the rightward terminus of pillow upper-edge 13 to the rightward hinged connection 17B, said right-edge 18B physically contacting pillow rightward secondary-segment 16B.

As clearly indicated in the drawing figures and in the foregoing text, the widthwise extending (i.e. FIG. 3) secondary-segments 16A and 16B serve to stably uprightly support the device (9) upon a reclining surface (RS).

Lambswool or other soft resiliently-compressible apron 19 might be stitched or otherwise topically applied at the apex of central-segment 15.

Elongate girth strap means (e.g. 20), for perpendicularly intersecting eges 13 and 14 and for controllably constrictably surrounding the central-segment (15), is attached to the device pillow portion. Herein, flexible fabric girth strap 20 has a regular narrow width between its terminal ends 22 and 28, and its first-end 22 is attached (as by stitching line 21) to a lower portion of pillow central-segment 15. As seen in FIG. 4A, girth strap 20 is significantly narrower than the finite-length of upper-edge 13; moreover, girth strap 20 is recessible within apron 19. Adjacent its terminal ends, girth strap 20 is provided with fastener means (e.g. VELCRO type fasteners 23 and 29) so that the girth strap means can be employed to controllably constrictably surround central-segment 15. Accordingly (and as alluded to in FIG. 4A), with regard to central-segment 15, the girth strap means is adapted to effect a selectable degree of upper-edge concavity (e.g. along 13) for stably cradling a horizontally extending body limb (e.g. leg L) and also a selectable degree of pillow resiliency beneath the cradled limb.

A pillow case provided of launderable or disposable material might be employed to removably encase the controllably constrictable and multi-compartments limb supporting device (e.g. 9). Moreover, the aforementioned topical apron (19) might be alternatively carried by such removable pillow case rather than by the pillow central-segment.

From the foregoing, the construction and operation of the limb supporting device concept will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. A limb supporting device for reclining persons and comprising a multi-segments resiliently-compressible pillow having a volumetrically predominate central-segment for supporting a reclining person's limb and also having two secondary-segments respectively hingedly connectably flanking the central-segment and for stabilizing the limb supporting device upon a reclining surface, said multi-segments pillow including a horizontal and directionally longitudinally extending upper-edge having a finite-length that is wholly defined by an upper extremity of the central-segment and also including a horizontally longitudinally extending lower-edge that is downwardly abuttable against a reclining surface and that is jointly defined by a lower edge of said central-segment and said flanking secondary-segments, and an elongate and narrow width girth strap attached to said pillow central-segment below and substantially perpendicular to the upper-edge thereof, said girth strap narrow width being significantly less than the upper-edge finite-length so as to be adapted to controllably constrictably surround the central-segment and effect a downwardly concave contour for the pillow upper-edge and thereby to provide a cradle-like support for the reclining person's generally horizontally extending limb.

2. The limb supporting device of claim 1 wherein the central-segment has a pair of inclined and downwardly convergent side edges including a left-edge extending from a leftward extremity of the pillow upper-edge to a hinged connection between the central-segment and a leftward secondary-segment and a right-edge extending from a rightward extremity of the pillow upper-edge to a hinged connection between the central-segment and the rightward secondary-segment.

3. The device of claim 2 wherein an upper portion of the leftward secondary-segment physically contacts the central-segment left-edge and an upper portion of the rightward secondary-segment physically contacts the central-segment right-edge.

4. The limb supporting device of claim 3 wherein the pillow segments comprise a flexible shell encloseably surrounding resiliently compressible filling material; and wherein said flexible shell is twice joined together horizontally in directions that are substantially perpendicular to the pillow lower-edge to provide said hingedly connected flanking secondary-segments.

5. The device of claim 4 wherein the flexible shell at the pillow upper-edge is topically provided with a soft and resiliently compressible shield.

6. The limb supporting device of claim 5 wherein the girth strap is adapted to perpendicularly intersect a central portion of the central-segment upper-edge.

7. The limb supporting device of claim 6 wherein the pillow segments comprise a flexible fabric shell encloseably surrounding resiliently compressible filling material; wherein said flexible fabric shell is twice stitchably joined together in horizontal directions perpendicular to the pillow lower-edge to provide said hingedly associated secondary-segments; and wherein the upper extremity of the limb supporting device takes the form of a soft and resiliently compressible apron-like shield.

8. The limb supporting device of claim 7 wherein the girth strap is adapted to perpendicularly intersect a central portion of the central-segment upper-edge.

9. A limb supporting device for reclining persons and comprising a multi-segments resiliently-compressible pillow having a volumetrically predominate central-segment for supporting a reclining person's limb and also having two secondary-segments respectively hingedly connectably flanking the central-segment and for stabilizing the limb supporting device upon a reclining surface, said multi-segments pillow including an upper-edge having a finite-length that is wholly defined by an upper extremity of the central-segment and also including a horizontal and directionally longitudinal lower-edge that is downwardly abuttable against a reclining surface and that is jointly defined by a lower edge of said central-segment and said flanking secondary-segments, and an elongate and narrow width girth strap attached to said pillow below the upper-edge thereof, said girth strap narrow width being substantially less than said upper-edge finite-length, said girth strap substantially perpendicularly intersecting central portions of the central-segment upper-edge and lower-edge and also centrally constricting the central-segment to effect a downwardly concave contour for the upper-edge thereof.

10. The limb supporting device of claim 9 wherein the downwardly concave upper portion only of the central-segment includes a soft and resiliently compressible apron-like shield, said girth strap abuttably overlying and being recessed within said soft apron-like shield.

* * * * *